United States Patent [19]

Shannon

[11] Patent Number: 4,518,568

[45] Date of Patent: May 21, 1985

[54] SYSTEM TO PRODUCE A BRINE-BASED DRILLING FLUID

[75] Inventor: Bruce L. Shannon, Salt Lake City, Utah

[73] Assignee: Standard Oil Company, Chicago, Ill.

[21] Appl. No.: 440,896

[22] Filed: Nov. 12, 1982

[51] Int. Cl.[3] ..... E21B 21/06

[52] U.S. Cl. ..... 422/261; 137/896; 175/206; 175/207; 422/282; 422/902

[58] Field of Search ..... 422/261, 282, 284, 902; 175/65, 70, 206, 207; 423/179, 658.5; 137/606, 896, 897

[56] References Cited

U.S. PATENT DOCUMENTS

| | | | |
|---|---|---|---|
| 557,068 | 2/1897 | Quinn | 422/278 |
| 2,122,900 | 7/1938 | Ubrmacher | 422/261 X |
| 2,245,886 | 6/1941 | Weir et al. | 175/65 X |
| 2,395,258 | 2/1946 | Drake | 422/171 |
| 2,631,017 | 3/1953 | Gibson et al. | 175/206 X |
| 2,642,268 | 6/1953 | Armentrout | 175/206 X |
| 2,886,287 | 5/1959 | Groley | 175/206 |
| 3,363,995 | 1/1963 | Driskoll et al. | 422/261 X |
| 3,404,963 | 10/1968 | Fritsche et al. | 423/179 |
| 3,642,623 | 2/1972 | Bennett et al. | 175/65 X |
| 3,800,026 | 3/1974 | Morgan | 423/179 |
| 4,076,628 | 2/1978 | Clampitt | 175/65 X |

FOREIGN PATENT DOCUMENTS

| | | | |
|---|---|---|---|
| 570692 | 12/1973 | U.S.S.R. | 175/206 |
| 717277 | 11/1977 | U.S.S.R. | 175/65 |
| 148472 | 1/1979 | U.S.S.R. | 175/65 |

*Primary Examiner*—Arnold Turk
*Assistant Examiner*—Brion P. Heaney
*Attorney, Agent, or Firm*—Scott H. Brown; Fred E. Hook

[57] ABSTRACT

A water-based drilling fluid preparation system having an enclosed mixing chamber, a salt barrel, and piping means for selectively directing fluids exiting the mixing chamber means through the salt supply and to and from a suction pit. The mixing chamber has a first inlet for supplying a first fluid, such as drilling muds, into the mixing chamber, a second inlet for supplying water into the mixing chamber, and a third inlet means for supplying a heated fluid into the mixing chamber, wherein the drilling fluids are mixed in a selectively heated environment.

3 Claims, 2 Drawing Figures

SYSTEM TO PRODUCE A BRINE-BASED DRILLING FLUID

FIELD OF THE INVENTION

The present invention relates to a system to produce a water-based drilling fluid and, more particularly, to such a system for producing a brine-based drilling fluid.

SETTING OF THE INVENTION

In the drilling of wells for fluid production, such as for oil or gas production, a drilling fluid is circulated through the drill string and the bit and returned through the drill string-casing annulus to the surface. This drilling fluid is used to cool and lubricate the drill bit and to remove the drill cuttings from the wellbore. When drilling through certain formations it is desirable to use a salt-saturated or brine-based drilling fluid. These fluids are generally formulated from salt water, a viscosifier, such as bentonite clay, and various other chemicals. If salt water with the necessary properties cannot be found on the drill site, then salt water needs to be transported to the drilling site, which can be very expensive especially in remote, arid regions. It would be beneficial to have the drilling rig provided with a transportable device for preparing a brine solution to be mixed with other drilling fluids.

Over the years several types of brine manufacturing devices have been invented, for example, Quinn, U.S. Pat. No. 577,068; Morgan, U.S. Pat. No. 3,800,026; Driskell, U.S. Pat. No. 3,363,995; and Fritsche et al., U.S. Pat. No. 3,404,963. These brine manufacturing devices disclose forcing heated water upwardly through a supply of salt and removing the produced brine for use elsewhere. None of these references disclose a system for the preparation of a drilling fluid which has the capability of mixing water and various drilling fluid additives for passage through a salt supply to produce a brine-based drilling fluid.

BRIEF SUMMARY OF THE INVENTION

The present invention provides a water-based drilling fluid preparation system which can be operated in conjunction with a drilling rig and having an enclosed mixing chamber with a first inlet for supplying a first fluid, such as a drilling mud, into the mixing chamber, a second inlet for supply water into the mixing chamber, and a third inlet for supplying heating fluid into the mixing chamber, wherein drilling fluids are mixed in a selectively heated environment. A salt supply is connected to the mixing chamber and piping is provided to selectively direct fluids exiting the mixing chamber through the salt supply. Additional piping can be provided to connect the mixing chamber with a supply of the drilling fluid exiting from the salt supply whereby a weighting material can be added to the supply of drilling fluid, the brine concentration of the supply of drilling fluid can be increased without increasing the water content of the drilling fluids, and the water content of the supply of drilling fluid can be increased without increasing the brine concentration of the drilling fluids.

DETAILED DESCRIPTION OF THE PREFERRED EMBODIMENTS

The present invention generally is a water-based drilling fluid preparation system, which has a mixing chamber into which water, a heat fluid supply source and drilling additives are introduced and mixed. The fluids exiting from the mixing chamber can pass through a salt supply to increase the brine concentration of the fluids and from there to a suction pit. The drilling fluids stored in the suction pit can thereafter be introduced into the wellbore for use in drilling and after removal from the wellbore are returned to the suction pit. By varying the inputs of the water, heat, and drilling fluid additives into the mixing chamber, a brine-based drilling fluid can be produced with the desired properties. Conduits and valves can be provided within the system to increase the brine concentration of the produced drilling fluid without increasing the water content and vice versa. Additional conduits and valves can be provided to add weighting materials, such as barite, into the produced drilling fluids.

Figure 1:
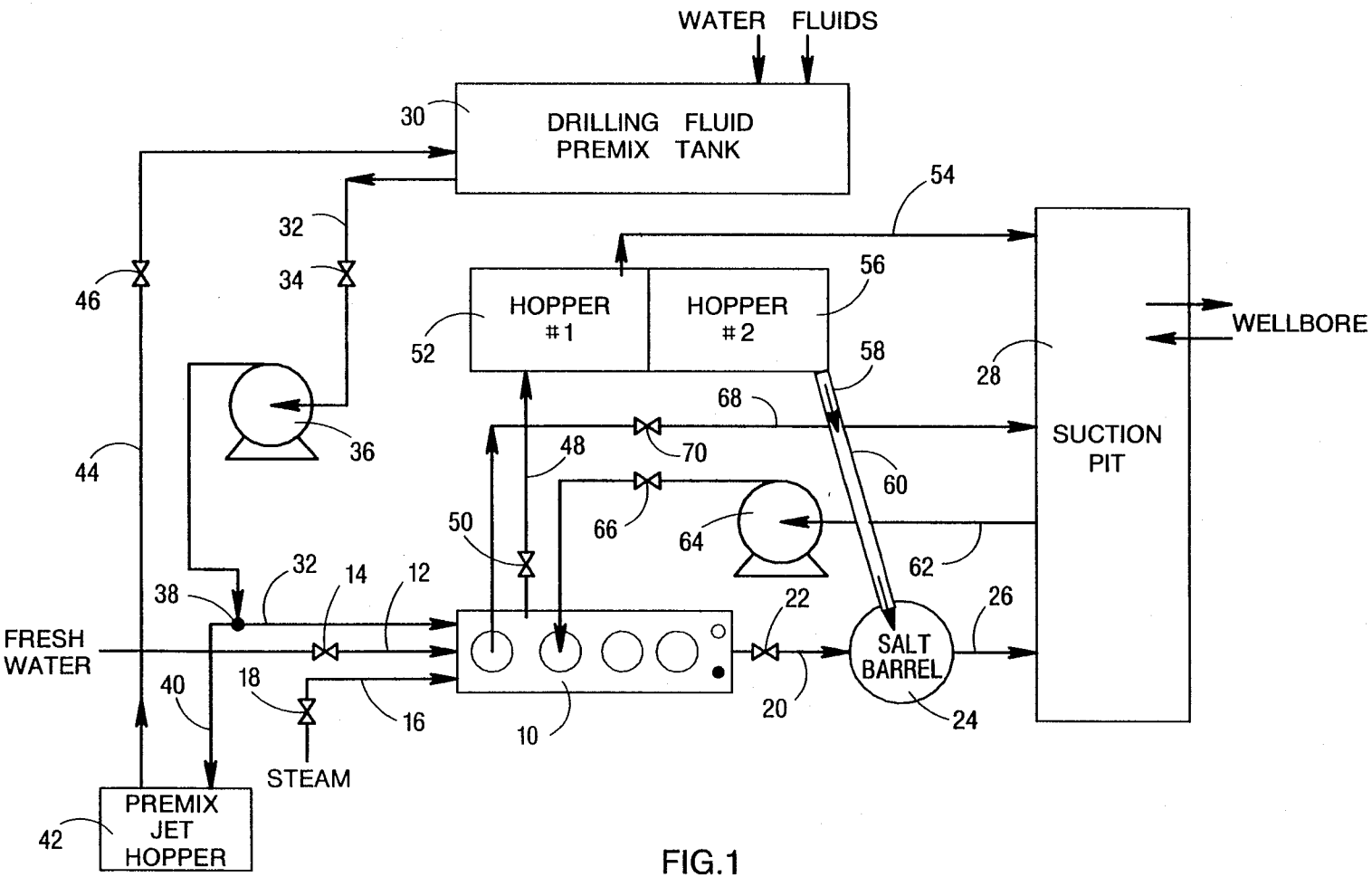
FIG. 1 is a semi-diagrammatic plane view of a brine-based drilling fluid preparation system embodying the present invention.
Figure 2:
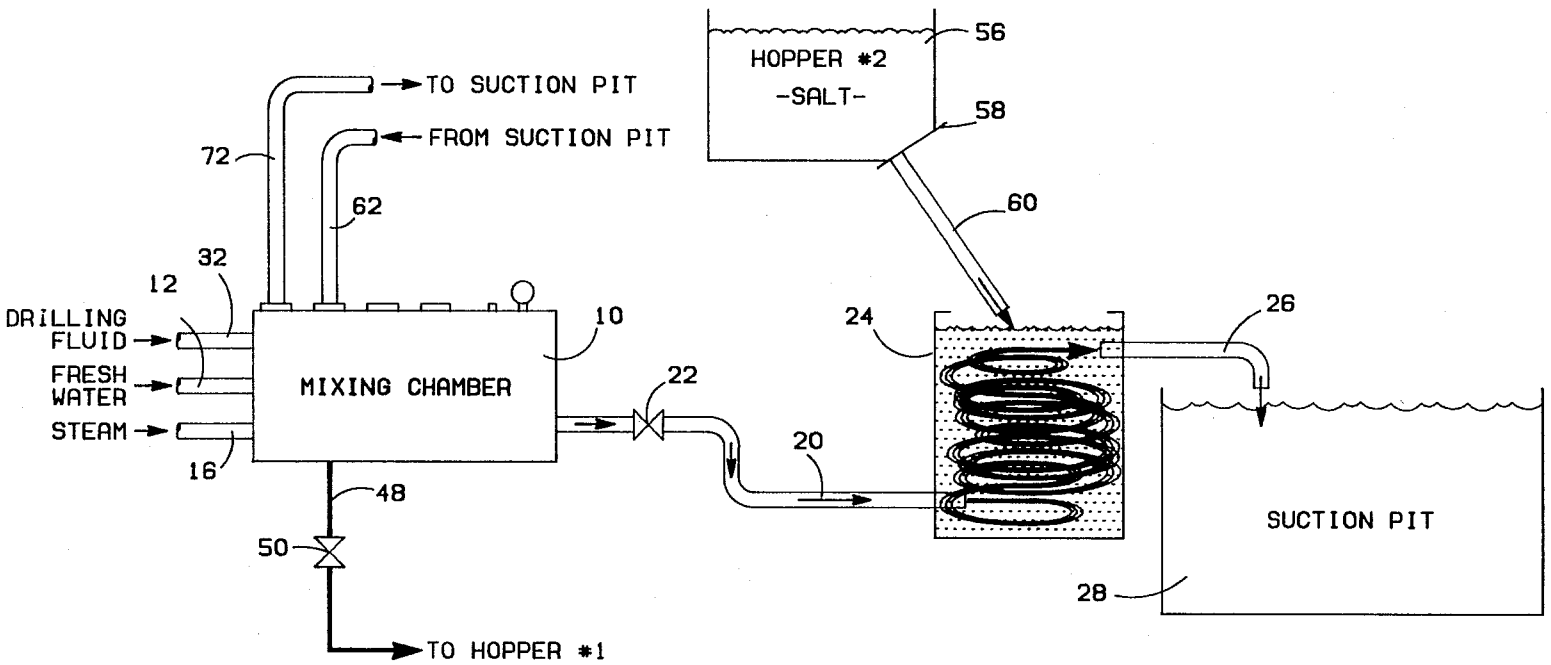
FIG. 2 is a semi-diagrammatic elevational view of selected features of the present invention.

Referring to FIGS. 1 and 2 in detail, reference character 10 generally indicates a hollow enclosure or mixing chamber, which can be of any suitable configuration including tubular, rectangular, or spherical. Water is introduced into the interior of the mixing chamber 10 through a conduit 12 and a valve 14 and hot water or steam is introduced into the interior of the mixing chamber 10 through a conduit 16 and a valve 18. Water or steam can be provided by any commercially available hot water or steam source, but preferably is the boiler or hot water system of the drilling rig.

Disposed within the interior of the mixing chamber 10 is a stringer or dispersion assembly (not shown) connected to the conduit 16. The stinger uniformly disperses the hot water or steam into and within the chamber 10. The heat is used to dissolve particulate salt, as will be discussed below, and also prevents the fluids in the mixing chamber 10 from freezing during winter operations.

A conduit 20 extends from an outlet in one end of the mixing chamber 10 and carries the fluids from the mixing chamber 10 through a valve 22 into communication with the lower portion of a salt barrel 24, which contains a supply of particulate crystalline potassium chloride or sodium chloride or any other suitable brine forming material. An output conduit 26 is connected to an upper portion of the salt barrel 24 and carries the effluent from the salt barrel 24 into a suction pit 28. As has been described above, the drilling fluid disposed within the suction pit 28 is pumped into the wellbore and after removal therefrom and treatment is returned to the suction pit 28.

The drilling fluid preparation system is also provided with a drilling fluid premix tank 30 into which water and drilling fluid additives, such as a viscosifier or gelling agent (bentonite mud) can be introduced. A conduit 32 extends from the drilling fluid premix tank 30 through a valve 34 and a pump 36 into the interior of the mixing chamber 10. Connected to the conduit 32 through a two-way valve 38 is a conduit 40 which extends into a premix jet hopper 42 and a conduit 44 extends from the premix jet hopper 42 through a valve 46 into the drilling fluid premix tank 30. Within the premix jet hopper 42 bentonite and water are mixed for introduction into the premix tank 30. Fluids can be passed through the conduit 32 to the conduit 40 and then to the hopper 42 and back to the tank 30 through the conduit 44, or the premixed fluids can be directed to the suction pit 28 through conduit 32 into the chamber 10. The fluids, which have been mixed within the premix jet hopper 42, can be introduced via another conduit (not shown) into the suction pit 28.

A conduit 48 extends from the interior of the mixing chamber 10 through a valve 50 to a first bulk hopper 52, which is provided with a supply of drilling fluid additives, such as weighting material. A conduit 54 extends from the interior of the bulk hopper 52 into the interior of the suction pit 28. A second bulk hopper 56, which can be attached to the first bulk hopper 52, contains a supply of salt crystals which are fed through a mechanically or manually operated gate 58 and down a trough 60 or conduit into the top of the salt barrel 24 to resupply the salt barrel 24.

A conduit 62 extends from the suction pit 28 through a pump 64 and a valve 66 into the interior of the mixing chamber 10 and a conduit 68 extends out from the mixing chamber 10 through a valve 70 back into communication with the interior of the suction pit 28. The lines 62 and 68 provide bypass piping, as will be described in more detail below.

To better understand the operation of the present system, the production of different kinds of drilling fluids will be described hereinbelow. To produce a brine-based drilling fluid, water is introduced through the valve 14 and the conduit 12 into the interior of the mixing chamber 10 and steam or hot water is introduced through the valve 18 and conduit 16 into the interior of the mixing tank 10. Viscosified drilling fluid prepared in the drilling fluid premix tank 30 is pumped through the conduit 32 and through the two-way valve 38 into the interior of the mixing chamber 10. The valve 22 is opened and the effluent from the mixing tank 10, after being heated and mixed, passes through the conduit 20 into the lower portion of the salt barrel 24 where the heated fluids percolate upward through the salt crystals to form a brine. The now salt saturated drilling fluids exit the salt supply 24 through the conduit 26 into the suction pit 28. By adjusting the various fluid and material inputs into the mixing chamber 10, a brine-based drilling fluid can be produced which has the desired characteristics.

To produce a drilling fluid which has weighting material, such as barite therein, the drilling fluid within the suction pit 28 is pumped through the conduit 62 and the opened valve 66 into the interior of the mixing chamber 10 and through the valve 50 and conduit 48 into the hopper 52, wherein barite is introduced to the flowing stream of drilling fluid. The now weighted drilling fluid passes through the conduit 54 back into the suction pit 28 by action of the pump 64.

In the event that the drilling fluid within the suction pit 28 is to have its water content increased without increasing its brine concentration or additives content, the drilling fluid within the suction pit 28 is introduced through the conduit 62 and the valve 66 into the interior of the mixing chamber 10. The valve 14 is opened and water flows into the interior of the mixing chamber 10, where the drilling fluid has its water content raised to the appropriate level. The valves 22 and 50 are maintained in a closed position and the valve 70 is opened and the drilling fluid is introduced via the conduit 68 directly back into the suction pit 28.

To increase the brine concentration of the drilling fluid without increasing its water content, the drilling fluid within the suction pit 28 is introduced through the conduit 62 and the valve 66 back into the interior of the mixing chamber 10. The valves 50 and 70 are maintained in a closed position and valve 22 is opened and the drilling fluid passes through the conduit 20 to the salt barrel 24 then through the line 26 back into the suction pit 28. Again, by varying the quantities of fluids, a drilling fluid with the desired properties can be produced.

It has been determined that the temperature of the hot water introduced into the mixing chamber 10 should be at least approximately 190° F. to dissolve the salt crystal stored within the salt barrel 24. It has been concluded that about four gallons per minute will be sufficient for an average supply of drilling fluid in areas with five to ten feet per hour drilling rates regardless of hole diameter. Further, it was determined that 4,800 BTU/minute would be required to elevate an inlet water temperature of about 45° F. to an outlet temperature of 190° F. A test unit of the present invention was constructed and which operated using a drilling rig boiler which was rated at 42,000 BTU/minute. Using a flow of water with a Cl− concentration below 20,000 ppm at a rate of 3 gals/min and a working pessure of 15 psi, a 10.1 lb/gal brine was produced having a concentration of 186,000 ppm Cl− with a temperature of 200° F. The system operated satisfactorily and less expensively than hauling in brine water.

The present invention can be operated to produce a water-based drilling fluid on a batch or a continuous basis. Further, the adding of weighting material, and increasing the brine concentration or water content of the drilling fluids can be operated in a batch or a continuous basis.

Whereas the present invention has been described in particular relation to the drawings attached hereto, it should be understood that other and further modifications apart from those shown or suggested herein may be made within the scope and spirit of the present invention.

I claim:

1. A system for preparing water-based drilling fluid comprising:

(a) an enclosed mixing chamber including first piping means including inlets for conveying supplies of water, heated fluid, and drilling fluid components into the interior of the mixing chamber;

(b) barrel means for retaining a supply of salt;

(c) second piping means for conveying fluid from the interior of the mixing chamber to the interior of the barrel means and for conveying fluid from the interior of the barrel means to a suction pit; and (d) third piping means for conveying fluid from the suction pit to the interior of the mixing chamber and for conveying fluid from the interior of the mixing chamber directly to the suction pit.

2. The system of claim 1 and including a drilling fluid additive container and fourth piping means for conveying fluid from the interior of the mixing chamber to the interior of the additive container to receive a quantity of drilling fluid additive, and for conveying the fluid and drilling fluid additive to the suction pit.

3. A system of claim 1 wherein the first piping means for conveying a supply of drilling fluid components comprises a drilling fluid tank and a fifth piping means for conveying supplies of water and drilling mud components into the interior of the drilling fluid tank, and to convey fluids from the interior of the drilling fluid tank to the interior of the mixing chamber.

* * * * *